US009771937B2

(12) United States Patent
Beez et al.

(10) Patent No.: US 9,771,937 B2
(45) Date of Patent: Sep. 26, 2017

(54) SPIRAL COMPRESSOR

(71) Applicant: Mahle International GmbH, Stuttgart (DE)

(72) Inventors: Steve Beez, Masserberg (DE); Marius Dusik, Reichenbach (DE); Jochen Eggler, Ostfildern (DE); Alfred Elsaesser, Keltern (DE); Sebastian Ewert, Stuttgart (DE); Achim Gommel, Simmozheim (DE); Karl-Heinz Hanslik, Stuttgart (DE); Ian Jago, Daventry (GB); Volker Kirschner, Muehlacker (DE); Ottokar Kunberger, Korntal-Muenchingen (DE); Ian Reynolds, Kettering (GB); Thomas Schmidt, Stuttgart (DE); Sascha Senjic, Stuttgart (DE); Hans C. Uibeleisen, Stuttgart (DE); Cihan Yilmaz, Neuhengstett (DE)

(73) Assignee: Mahle International GmbH (DE)

( * ) Notice: Subject to any disclaimer, the term of this patent is extended or adjusted under 35 U.S.C. 154(b) by 247 days.

(21) Appl. No.: 14/761,867

(22) PCT Filed: Jan. 10, 2014

(86) PCT No.: PCT/EP2014/050407
§ 371 (c)(1),
(2) Date: Jul. 17, 2015

(87) PCT Pub. No.: WO2014/111318
PCT Pub. Date: Jul. 24, 2014

(65) Prior Publication Data

US 2015/0369243 A1 Dec. 24, 2015

(30) Foreign Application Priority Data

Jan. 18, 2013 (DE) ..... 10 2013 200 807

(51) Int. Cl.
*F04C 18/02* (2006.01)
*F04C 29/00* (2006.01)
(Continued)

(52) U.S. Cl.
CPC ..... *F04C 18/0215* (2013.01); *F01C 17/06* (2013.01); *F01C 17/066* (2013.01);
(Continued)

(58) Field of Classification Search
CPC ..... F04C 2/321–2/336; F04C 2/348; F04C 2/352; F04C 2/46; F04C 29/0057;
(Continued)

(56) References Cited

U.S. PATENT DOCUMENTS 801,182 A 10/1905 Creux
2,859,911 A 11/1958 Reitter
(Continued)

FOREIGN PATENT DOCUMENTS

AT 247727 B 6/1966
DE 506697 C 9/1930
(Continued)

*Primary Examiner* — Mark Laurenzi
*Assistant Examiner* — Xiaoting Hu
(74) *Attorney, Agent, or Firm* — Fishman Stewart PLLC

(57) ABSTRACT

A spiral compressor may include a stationary first spiral member and an orbiting second spiral member intermeshing with the first spiral member. The spiral compressor may include a pendulum slide mechanism that may have an inner ring and a stationary outer ring connected to the inner ring via a plurality of pendulums. The pendulum slide mechanism may include an eccentric member disposed on a radial inside of the inner ring with respect to a central access of the inner ring. The inner ring on an inner circumferential side may be drivingly connected to the eccentric member and on an outer circumferential side may be rigidly connected to the second spiral member. The second spiral member may
(Continued)

transmit an orbiting motion in relation to the first spiral member via the pendulum slide mechanism when the eccentric member is driven.

20 Claims, 5 Drawing Sheets

(51) Int. Cl.

| | |
|---|---|
| ***F04C 2/332*** | (2006.01) |
| ***F04C 2/324*** | (2006.01) |
| ***F01C 17/06*** | (2006.01) |
| ***F04C 23/00*** | (2006.01) |
| ***F04C 11/00*** | (2006.01) |
| ***F04C 2/336*** | (2006.01) |
| *F04C 28/02* | (2006.01) |
| *F04C 14/02* | (2006.01) |

(52) U.S. Cl.
CPC ..... *F04C 2/324* (2013.01); *F04C 2/332* (2013.01); *F04C 2/336* (2013.01); *F04C 11/005* (2013.01); *F04C 23/005* (2013.01); *F04C 29/0057* (2013.01); *F04C 29/0085* (2013.01); *F04C 14/02* (2013.01); *F04C 28/02* (2013.01)

(58) Field of Classification Search
CPC .. F04C 18/0215; F04C 15/0065; F01C 17/00; F01C 17/06; F01C 17/063; F01C 17/066; F16D 3/04
USPC ..... 418/55.1–55.6, 172, 173, 176, 266–268; 464/102, 103, 104, 105
See application file for complete search history.

(56) References Cited

U.S. PATENT DOCUMENTS

| | | | | | |
|---|---|---|---|---|---|
| 4,125,031 | A * | 11/1978 | Swain | F01C 17/06 | 418/173 |
| 4,371,323 | A * | 2/1983 | Fischer | F01C 1/0215 | 418/182 |
| 4,795,323 | A * | 1/1989 | Lessie | F01C 17/063 | 418/55.3 |
| 4,927,339 | A * | 5/1990 | Riffe | F04C 27/005 | 418/109 |
| 4,927,340 | A * | 5/1990 | McCullough | F01C 1/023 | 418/55.3 |
| 5,842,844 | A | 12/1998 | Oki et al. | | |
| 5,934,890 | A * | 8/1999 | Mihara | F01C 17/06 | 418/55.3 |
| 2002/0182094 | A1 | 12/2002 | Mori et al. | | |
| 2011/0033329 | A1 * | 2/2011 | Iizuka | F01C 1/0215 | 418/55.1 |
| 2012/0076678 | A1 | 3/2012 | Yamashita | | |

FOREIGN PATENT DOCUMENTS

| | | | | |
|---|---|---|---|---|
| DE | 1126405 | B | 3/1962 | |
| DE | 2927690 | A1 | 1/1981 | |
| DE | 10334672 | B3 * | 1/2005 | F01C 1/336 |
| DE | 69631306 | T2 | 2/2005 | |
| FR | 2519382 | A1 | 7/1983 | |
| GB | 2054045 | A | 2/1981 | |
| WO | WO-2011/135324 | A2 | 11/2011 | |

* cited by examiner

SPIRAL COMPRESSOR

CROSS-REFERENCE TO RELATED APPLICATIONS

This application claims priority to German Patent Application No. 10 2013 200 807.4, filed Jan. 18, 2013, and International Patent Application No. PCT/EP2014/050407, filed Jan. 10, 2014, both of which are hereby incorporated by reference in their entirety.

TECHNICAL FIELD

The present invention relates to a spiral compressor comprising a stationary first spiral and an orbiting second spiral that meshes with the first spiral.

BACKGROUND

Spiral compressors, usually also called scroll compressors, are machines which can compress gases. They consist of two spirals nested into one another, the motion of which in the opposite direction compresses the gas. Spiral compressors operate here by the displacement body principle, wherein one of the two spirals is stationary, whilst the other is guided on a circular path by means of an eccentric drive. Here, the spirals touch one another several times and form within the windings several chambers which become continuously smaller, whereby the gas which is to be pumped is drawn in externally, compressed within the pump and discharged via a connection in the spiral centre. Such spiral compressors are usually also used for compressors in cooling units or heat pumps.

From DE 696 31 306 T2 a generic spiral compressor for compressing a fluid is known, comprising a housing arrangement for forming an outer basic framework of the compressor, which is provided with an inlet opening for the introduction of the fluid into the compressor, and an outlet. By means of a rotation-preventing arrangement, a second movable spiral is forced here to an orbiting motion. For this, the rotation-preventing arrangement has a plurality of pin and ring compositions, wherein each has a pair of pins which are respectively mounted on a compressor housing and the spiral. Hereby, substantially an identical stress is to act on each pair of pins of the plurality of pin and ring compositions.

From U.S. Pat. No. 801,182 a generic spiral compressor is also known.

SUMMARY

The present invention is concerned with the problem of indicating an improved embodiment for a spiral compressor of the generic type, which is distinguished in particular by an alternative structure of a rotation-preventing arrangement.

This problem is solved according to the invention by the subject of the independent claims. Advantageous embodiments are the subject of the dependent claims.

The present invention is based on the general idea, in a spiral compressor known per se comprising a stationary first spiral and an orbiting second spiral that meshes with the first spiral, of replacing a hitherto used rotation-preventing arrangement or anti-rotation arrangement which generates the orbiting motion of the second spiral, with a pendulum slide mechanism. Such a pendulum slide mechanism offers the great advantage of being able to realize the orbiting motion of the second spiral with comparatively small moved masses and a small noise development. At the same time, a spiral compressor with such a pendulum slide mechanism offers a high degree of efficiency compared to previous spiral compressors. The term "spiral compressor" is to be understood here to mean expressly not only a compressor which increases the density of the fluid which is to be conveyed, for example the gas which is to be conveyed, but in the same way also an expansion machine, which reduces the density of the fluid which is to be conveyed by expanding the gas in the spiral chambers. Hereby, for example, an electric motor can be used as generator. In the whole of the present patent application, the term "spiral compressor" can therefore be replaced by the terms "compressor" or "expansion machine". According to the invention, the pendulum slide mechanism now has an inner ring and a fixed/stationary outer ring connected therewith via pendulum, wherein the inner ring on the one hand has a rotatable driving connection to an eccentric and on the other hand is rigidly connected to the second spiral, such that the second spiral performs the required orbiting motion in particular in relation to the first spiral, due to the pendulum slide mechanism when the eccentric is driven. The invention therefore replaces the scroll gear necessary hitherto for generating the orbiting motion, by the pendulum slide mechanism.

In an advantageous further development of the solution according to the invention, the pendulums are mounted articulatedly on the inner ring and are guided in pendulum guide grooves, running in radial direction, in the outer ring. Likewise, a reverse construction is also conceivable, in which the pendulums are articulatedly mounted on the outer ring and are guided in pendulum guide grooves, running in radial direction, in the inner ring. Both embodiments permit the provision here of a rotation-preventing arrangement for the second spiral, wherein purely theoretically the pendulum slide mechanism can be additionally embodied for the conveying of a fluid, for example of a separate fluid or for the initial compressing of the fluid which is recompressed in the spiral compressor.

Expediently, the pendulum guide grooves have in the entry region lateral groove walls with a sliding radius. Such a sliding radius, which is constructed in the manner of rounded-out groove walls, enables a particularly smooth movement of the pendulum slide mechanism, whereby in particular the efficiency of the spiral compressor according to the invention can be increased.

In an advantageous further development of the solution according to the invention, the pendulums are constructed as double pendulums with an inner leg and with an outer leg articulately connected therewith. In this embodiment, pendulum guide grooves are not arranged in the inner ring or in the outer ring, but rather the pendulums are articulatedly connected respectively to the inner ring or respectively to the outer ring. The advantage of such a double pendulum lies in particular in a low-wear and smooth movement.

In a further embodiment, the pendulums are articulatedly connected with a sliding element, which is guided in the respective pendulum guide groove. Such a sliding element facilitates under certain circumstances the sliding movement of the pendulum in the radial groove and, furthermore, owing to a construction in terms of a piston, enables a separate compressing or respectively expanding of a further fluid or respectively the provision of a further compression/expansion stage. Through the pendulum slide mechanism, basically two further compression stages can be realized here, namely the first between the inner ring and the outer ring and the second between the pendulum and the pendulum guide groove, so that together with the first and second spiral, purely theoretically a three-stage compressor can be provided, or purely theoretically three separate fluids can be compressed or respectively expanded.

In a further advantageous embodiment of the solution according to the invention, the inner ring is constructed in one piece or in one part with the second spiral. Hereby, a mounting of the second spiral on the inner ring is superfluous, because in a one-piece construction these are produced together from a single piece. Of course, a one-part construction of the two said components is also conceivable, so that the spiral can be connected with the inner ring directly or indirectly via an intermediate piece.

Further important features and advantages of the invention will emerge from the subclaims, from the drawings and from the associated figure description with the aid of the drawings.

It shall be understood that the features mentioned above and to be explained in further detail below are able to be used not only in the respectively indicated combination, but also in other combinations or in isolation, without departing from the scope of the present invention.

A preferred example embodiment of the invention is illustrated in the drawings and is explained in further detail in the following description.

BRIEF DESCRIPTION OF THE DRAWINGS

There are shown here, diagrammatically respectively

DETAILED DESCRIPTION

Figure 1:
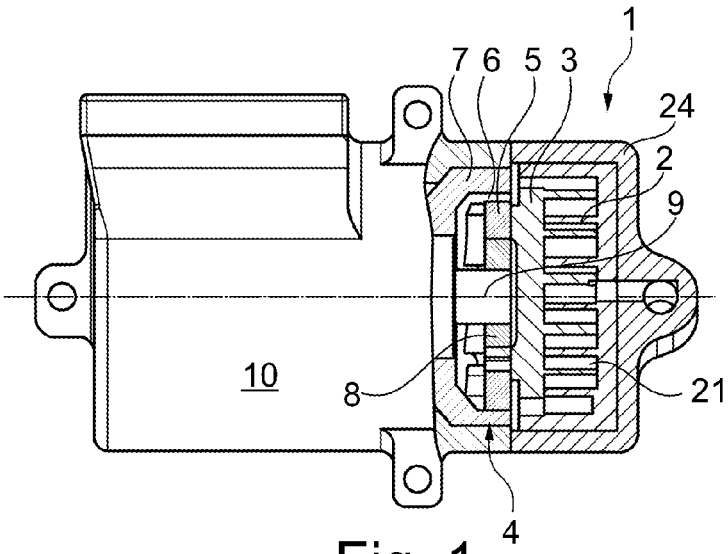
FIG. 1 a sectional illustration through a spiral compressor according to the invention, FIGS. 2A through 2C different possible embodiments of the pendulum slide mechanism according to the invention, FIG. 3 an illustration of a pendulum with additional sliding element, FIG. 4A an illustration of the pendulum slide mechanism with an asymmetrical pendulum, FIG. 4B a symmetrical pendulum as is guided in a pendulum guide groove with a sliding radius, FIG. 5 a pendulum slide mechanism with separate outer ring, FIG. 6 an illustration as in FIG. 5, wherein, however, the outer ring is integrated into a housing, FIG. 7 a view, partially in section, onto the spiral compressor with inner ring and second spiral constructed separately thereto, which are connected to one another via a connecting element, FIG. 8 an illustration as in FIG. 7, wherein, however, inner ring and second spiral are constructed in one piece, FIG. 9 a similar illustration as in FIG. 7, wherein, however, the inner ring of the pendulum slide mechanism is connected directly to the second spiral, FIG. 10 a further view, partially in section, of the spiral compressor according to the invention, in which inner ring, pendulums, pendulum guide grooves and outer ring are situated in a plane, FIG. 11 an illustration as in FIG. 10, in which, however, the outer ring, the pendulums and the inner ring of the pendulum slide mechanism are situated in different planes.

According to FIGS. 1 and 5 to 11, a spiral compressor 1 according to the invention has a stationary first spiral 2 and an orbiting second spiral 3 that meshes with the first spiral. The region around the spirals 2, 3 is closed off here by a cover 24. The spiral compressor 1 can also be operated here as an expansion machine by a switchover process, i.e. a reversal of rotation direction, so that in the following the spiral compressor 1 is in fact always mentioned, but of course this can also include an expansion machine 1. In order to now realize the orbiting motion of the second spiral 3 relative to the first spiral 2, a scroll gear, used hitherto for this, is replaced according to the invention by a pendulum slide mechanism 4, which has an inner ring 5 and a stationary outer ring 7 connected therewith via pendulum 6. The inner ring 5 has, on the one hand, a rotatable driving connection with an eccentric 8, which in turn is connected in a torque-proof manner with a shaft 9, for example driven by an electric motor 10 or by a belt pulley, which is not shown. On the other hand, the inner ring 5 is rigidly connected to the second spiral 3, such that the second spiral 3 performs the required orbiting motion in relation to the first spiral 2 due to the pendulum slide mechanism 4 when the eccentric 8 is driven. Through the use according to the invention of the pendulum slide mechanism 4 as rotation-preventing arrangement for the second spiral 3, an easy running and low-noise operation of the spiral compressor 1 or respectively of the expansion machine 1 can be achieved. Compared to a scroll gear used here hitherto, the pendulum slide mechanism 4 also has distinctly smaller moved masses, whereby less energy must be expended for operating the spiral compressor 1.

Figure 2A:
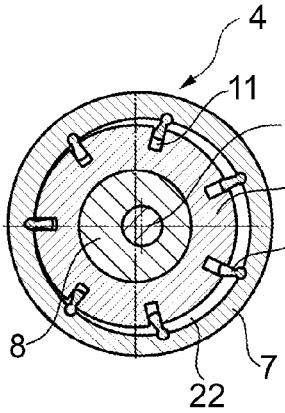
Figure 2B:
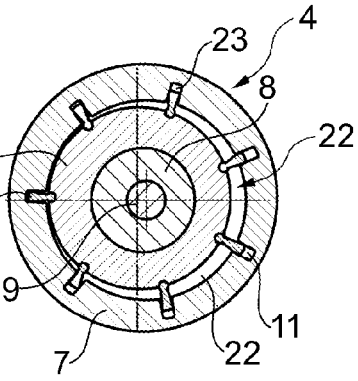
Figure 2C:
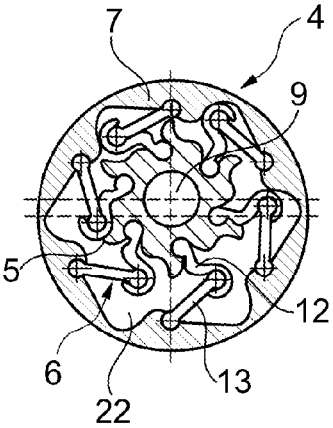
Figure 3:
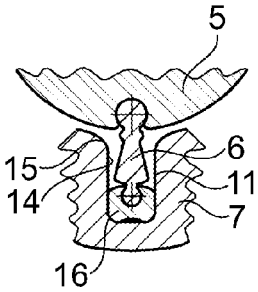

In FIGS. 2A to 2C different embodiments of the pendulum slide mechanism 4 according to the invention are illustrated. According to FIG. 2A, the pendulums 6 are mounted articulatedly on the outer ring 7 and are guided in pendulum guide grooves 11, running in radial direction, in the inner ring 5. FIG. 2B shows the reversed embodiment to this, in which the pendulums 6 are mounted articulatedly on the inner ring 5 and are guided in pendulum guide grooves 11, running in radial direction, in the outer ring 7. Generally, the pendulum slide mechanism 4 should have at least three pendulums 6, but preferably it has more, in particular six or seven pendulums 6.

When one observes FIG. 2C, it can be seen that the pendulums 6 are constructed as double pendulums with respectively an inner leg 12 and an outer leg 13. In these double pendulums, the outer leg 13 is connected articulatedly with the outer ring 7 and, at the same time, is connected articulatedly with the inner leg 12, whereas the inner leg 12 is connected via a type of knee joint articulatedly with the outer leg 13 and, on the other hand is connected articulatedly with the inner ring 5. Pendulum guide grooves 11 are not necessary in this embodiment of the pendulum slide mechanism 4. The pendulums 6 constructed as a double pendulum enable a very low-wear operation, because through the pendulums 6, constructed as a double pendulum, the friction previously occurring between the pendulums 6 and the outer ring 7 can be distinctly reduced. The spiral compressor 1 according to the invention is also distinguished by quiet running.

Figure 4A:
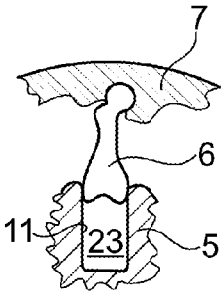
Figure 4B:
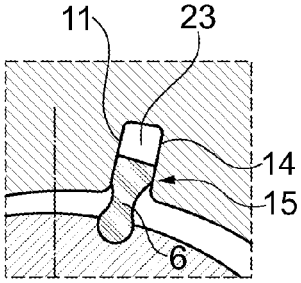

The pendulums 6 according to FIGS. 2A, 2B, 3 and 4B are, moreover, constructed symmetrically, with asymmetrical pendulums 6 of course also being able to be come into use, as is illustrated for example according to FIG. 4A. In order, moreover, to guarantee a smooth operation of the pendulum slide mechanism 4, the pendulum guide grooves 11 can have lateral groove walls 14 with a sliding radius 15 in the entry region, as is illustrated according to the detail illustration in FIG. 4B.

Looking again at the pendulum slide mechanisms 4 according to FIGS. 2A to 2C, it can be seen that the individual pendulums 6 are arranged on the inner ring 5 or respectively on the outer ring 7, distributed symmetrically over the circumference, i.e. are distributed uniformly over the circumference, wherein of course also an asymmetrical arrangement, not shown, on the circumference of the inner ring 5 or respectively of the outer ring 7 is conceivable. A sliding element 16, as is illustrated according to FIG. 3, which slides in a piston-like manner in the associated pendulum guide groove 11, can likewise be provided. In this case, therefore, the pendulum 6 is articulatedly connected to the inner ring 5 or to the outer ring 7 and articulatedly connected to the sliding element 16.

Figure 5:
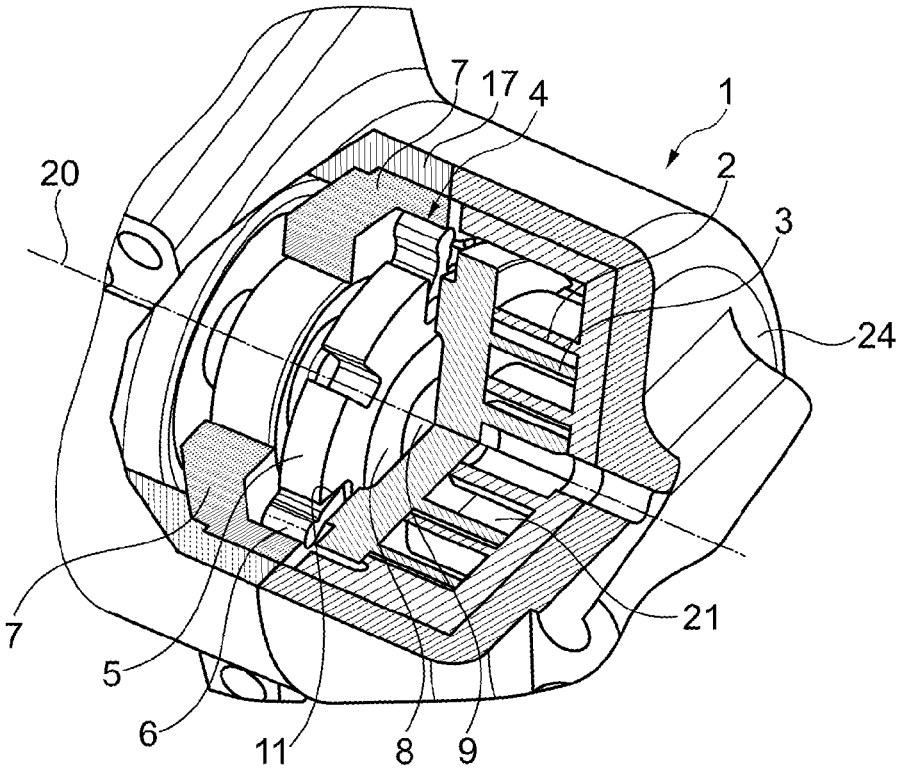
Figure 6:
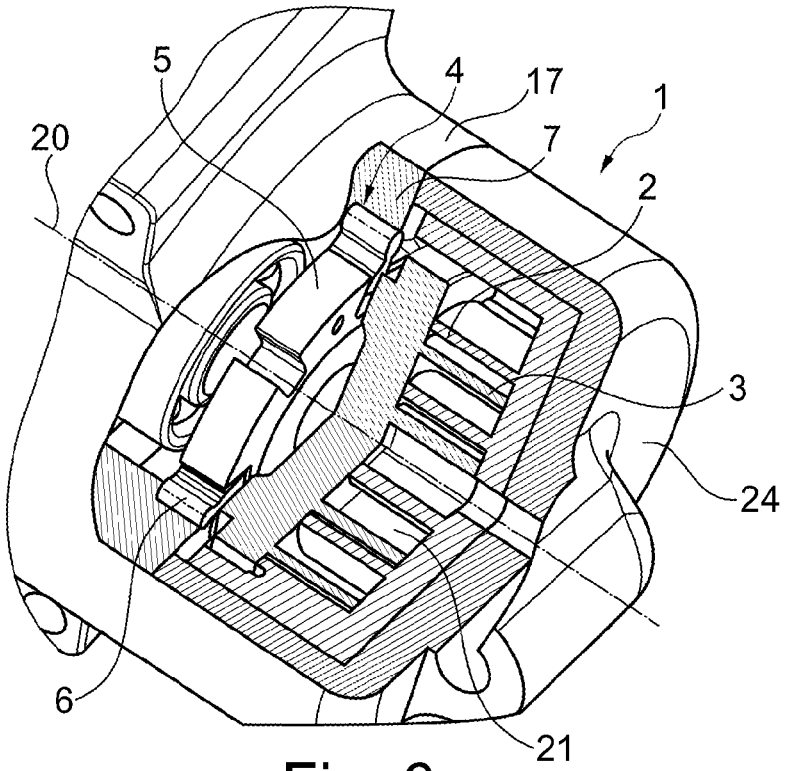

When one observes the embodiments of the spiral compressor 1 or respectively of the expansion machine 1 according to FIGS. 5 and 6, it can be seen in FIG. 5 that the outer ring 7 is a separate component in relation to a housing 17 of the spiral compressor 1, whereas in the illustration according to FIG. 6 the outer ring 7 is a component of the housing 17 of the spiral compressor 1.

Figure 7:
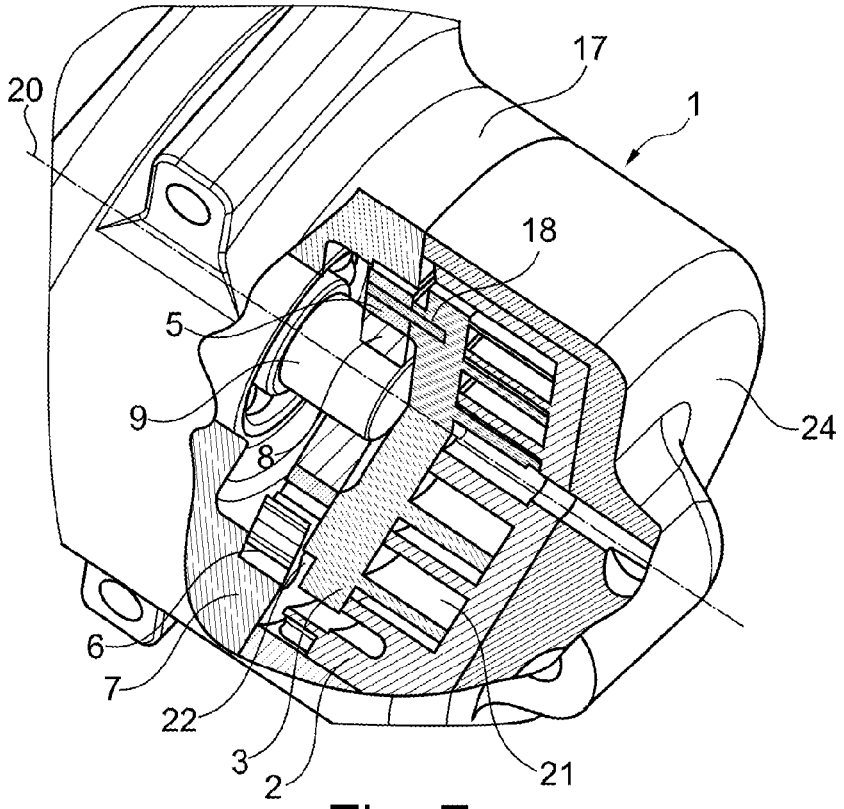
Figure 8:
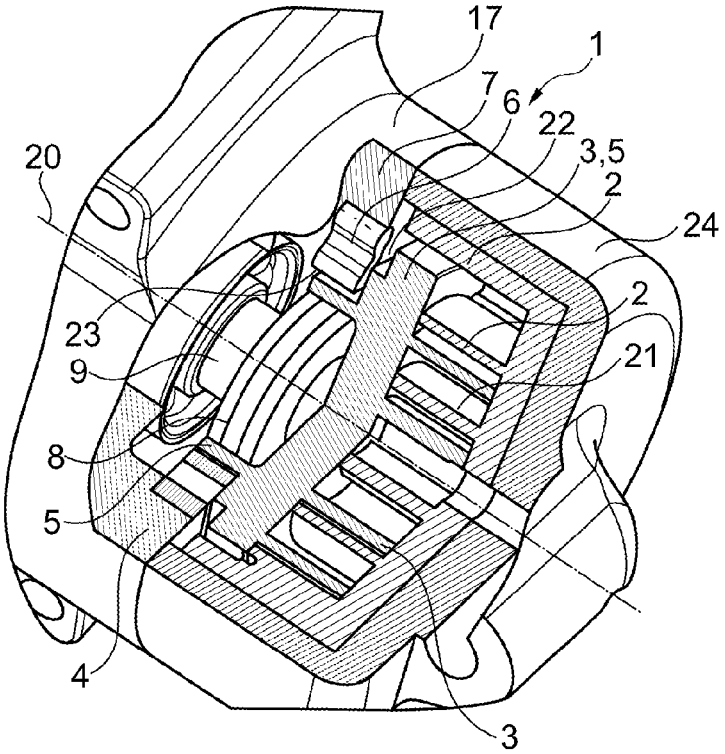
Figure 9:
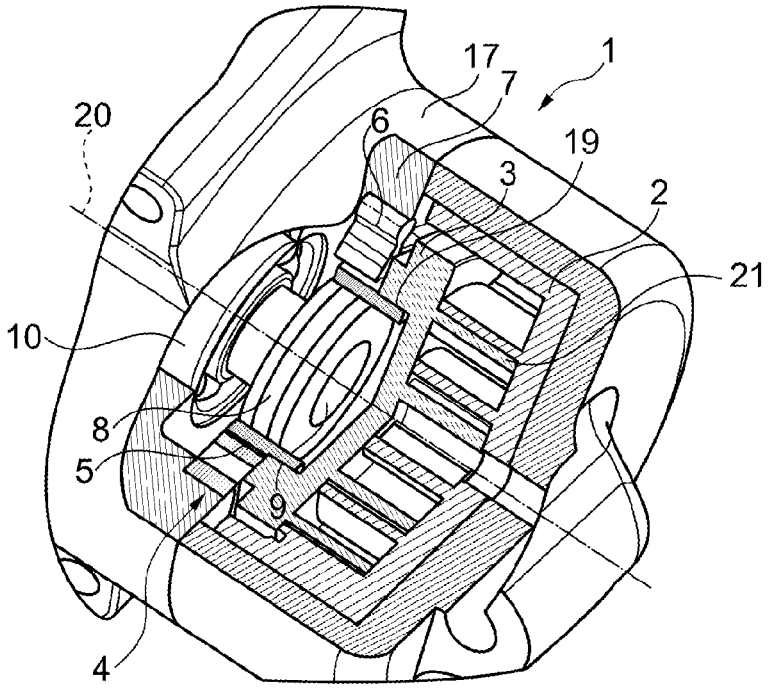

According to FIG. 7, the inner ring 5 is connected to the second spiral 3 via a connecting element 18, whereas in FIG. 8 the inner ring 5 is constructed in one piece with the second spiral 3. A further alternative embodiment to this is illustrated in FIG. 9, in which the inner ring 5 is connected directly to the second spiral 3, for example via a join connection 19. Such a join connection 19 can be, for example, a thermal join connection or a connection by means of welding, soldering or gluing.

Figure 10:
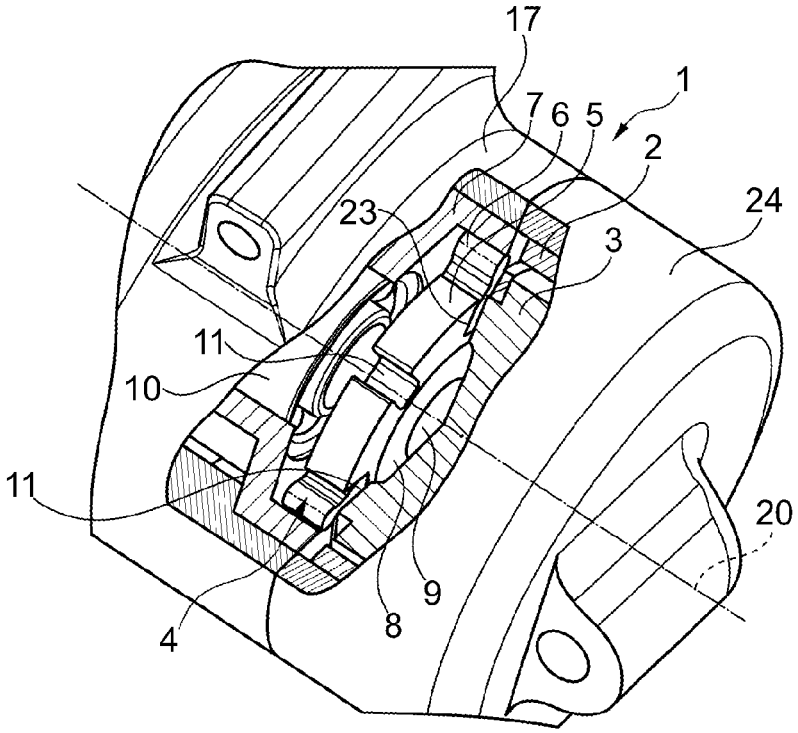
Figure 11:
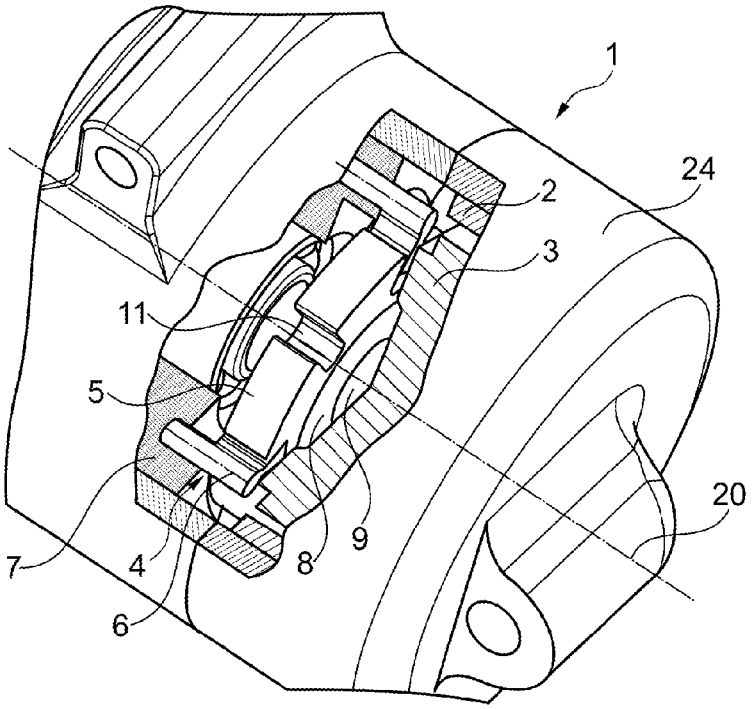

Finally, when one observes the spiral compressor 1 according to FIG. 10, it can be seen that in this the inner ring 5, the pendulums 6 and parts of the outer ring 7 lie in a plane in relation to an axis 20 of the spiral compressor 1. The spiral compressor 1 according to FIG. 11 is constructed in a similar manner, wherein there it can clearly be seen that the pendulums 6 extend between two planes, wherein in the first plane a portion of the pendulums 6 and the inner ring 5 of the pendulum slide mechanism 4 are arranged, whereas in the second plane likewise a portion of the pendulums 6 and the outer ring 7 are arranged. The inner ring 5 and the outer ring 7 are therefore operatively connected with one another via the pendulums 6 extending over both planes.

Generally, by the replacement of the hitherto necessary scroll gear for generating the orbiting motion of the second spiral 3 by means of the pendulum slide mechanism 4 according to the invention a spiral compressor 1 or respectively an expansion machine 1 can be created, which owing to smaller moved masses requires less energy for driving and, at the same time, operates in a low-noise manner and with a high degree of efficiency.

Moreover, with the pendulum slide mechanism 4 according to the invention it is possible to convey further fluids separately from that which is compressed or respectively expanded by means of the first and second spiral 2, 3. The spiral compressor 1 according to the invention can therefore compress or respectively expand a gas in first chambers 21 and further fluids in second chambers 22 or respectively third chambers 23. The first chambers 21 lie here between the first and second spiral 2, 3, whereas the second chambers are arranged between the inner ring 5, the outer ring 7 and the pendulums 6. The third chambers 23 in turn are delimited on the one hand by the pendulum 6 or respectively sliding element 16 and on the other hand by the pendulum guide groove 11. Purely theoretically, therefore, up to three separate fluids can be compressed or respectively expanded with the spiral compressor 1 according to the invention, wherein alternatively it is also conceivable that the first, second and third chambers 21, 22 and 23 constitute compression or respectively expansion stages connected in series.

The spiral compressor 1 according to the invention can be used for example as a compressor in the region of air-conditioning systems or respectively cooling units, in particular also in motor vehicles.

The invention claimed is:

1. A spiral compressor, comprising:

a stationary first spiral member and an orbiting second spiral member intermeshing with the first spiral member, and a pendulum slide mechanism disposed on an axial side of the second spiral member, the pendulum slide mechanism including:

an inner ring, a stationary outer ring connected to the inner ring via a plurality of pendulums and an eccentric member disposed on a radial inside of the inner ring with respect to a central axis of the inner ring, wherein the inner ring on an inner circumferential side is drivingly connected to the eccentric member and on an outer circumferential side is rigidly connected to the second spiral member, and wherein the second spiral member transmits an orbiting motion in relation to the first spiral member via the pendulum slide mechanism when the eccentric member is driven.

2. The spiral compressor according to claim 1, wherein the plurality of pendulums are mounted articulately on one of the inner ring and the outer ring and are guided in a plurality of associated pendulum guide grooves extending in a radial direction in the other of the inner ring and the outer ring.

3. The spiral compressor according to claim 2, wherein the plurality of pendulum guide grooves are arranged one of symmetrically and asymmetrically on at least one of the inner ring and the outer ring.

4. The spiral compressor according to claim 2, further comprising a sliding element disposed in at least one pendulum guide groove, wherein the associated pendulum is articulately connected to the sliding element.

5. The spiral compressor according to claim 2, wherein the plurality of pendulums respectively have an asymmetric shape.

6. The spiral compressor according to claim 2, wherein the plurality of pendulums are respectively double pendulums having an inner leg articulately connected to an outer leg.

7. The spiral compressor according to claim 1, wherein at least one of the inner ring and the outer ring includes a plurality of pendulum guide grooves receiving the plurality of pendulums, and wherein the plurality of pendulums guide grooves have in an entry region at least two lateral groove walls defining a sliding radius.

8. The spiral compressor according to claim 7, further comprising a plurality of sliding elements disposed in the plurality of pendulum guide grooves, the plurality of sliding elements configured to slide with a reciprocating motion in the plurality of pendulum guide grooves, and wherein the plurality of associated pendulums are articulately connected to the plurality of sliding elements.

9. The spiral compressor according to claim 1, wherein at least one of the plurality of pendulums has an asymmetric shape.

10. The spiral compressor according to claim 9, wherein the inner ring is directly connected with the second spiral member.

11. The spiral compressor according to claim 9, wherein the inner ring is indirectly connected with the second spiral member via at least one further component.

12. The spiral compressor according to claim 1, wherein the plurality of pendulums respectively include double pendulums with an inner leg articulately connected to an outer leg.

13. The spiral compressor according to claim 1, wherein the outer ring is one of a separate component and integral with a housing of the spiral compressor.

14. The spiral compressor according to claim 1, wherein at least one of:

the inner ring is configured as at least one of one piece and one part with the second spiral member, the inner ring is connected directly with the second spiral member, and the inner ring is connected with the second spiral member via at least one further component.

15. The spiral compressor according to claim 1, wherein one of:

the inner ring, the plurality of pendulums and the outer ring are arranged in a common plane, and at least one of the inner ring, the plurality of pendulums and the outer ring is arranged in a different plane from the other of the inner ring, the plurality of pendulums and the outer ring.

16. The spiral compressor according to claim 1, wherein at least one of:

the plurality of pendulums includes at least three pendulums, and the eccentric member is driven via at least one of an electric motor and a belt pulley.

17. The spiral compressor according to claim 1, wherein the inner ring, the plurality of pendulums and the outer ring are arranged in a common plane.

18. The spiral compressor according to claim 1, wherein at least one of the inner ring, the plurality of pendulums and the outer ring is arranged in a different plane from the other of the inner ring, the plurality of pendulums and the outer ring.

19. The spiral compressor according to claim 1, wherein the inner ring is arranged in a first plane and the outer ring is arranged on a second plane different from the first plane, and wherein the plurality of pendulums traverse the first plane and the second plane.

20. A spiral compressor, comprising:

a stationary first spiral member and an orbiting second spiral member intermeshing with the first spiral member; and a pendulum slide mechanism disposed on an axial side of the second spiral member, the pendulum slide mechanism including:

an inner ring;

a stationary outer ring;

a plurality of pendulums connecting the inner ring to the outer ring, wherein the plurality of pendulums are mounted articulately on one of the inner ring and the outer ring and are guided in a plurality of associated pendulum guide grooves on the other of the inner ring and the outer ring, wherein the plurality of pendulum guide grooves extend in a radial direction with respect to a central axis of the inner ring; and an eccentric member disposed on a radial inside of the inner ring;

wherein the inner ring on an inner circumferential side is drivingly connected to the eccentric member and on an outer circumferential side is rigidly connected to the second spiral member, and wherein the second spiral member transmits an orbiting motion in relation to the first spiral member via the pendulum slide mechanism when the eccentric member is driven.

* * * * *